US008354213B2

(12) United States Patent
Vanbesien et al.

(10) Patent No.: US 8,354,213 B2
(45) Date of Patent: Jan. 15, 2013

(54) TONER COMPOSITIONS

(75) Inventors: Daryl W. Vanbesien, Burlington (CA); Karen Ann Moffat, Brantford (CA); Yi Xin Gong, Mississauga (CA); Edul N. Dalal, Webster, NY (US); Jing Wang, Milpitas, CA (US); Richard P. N. Veregin, Mississauga (CA); Jordan H. Wosnick, Toronto (CA); Cuong Vong, Hamilton (CA); Valerie M. Farrugia, Oakville (CA)

(73) Assignee: Xerox Corporation, Norwalk, CT (US)

( * ) Notice: Subject to any disclaimer, the term of this patent is extended or adjusted under 35 U.S.C. 154(b) by 500 days.

(21) Appl. No.: 12/689,473

(22) Filed: Jan. 19, 2010

(65) Prior Publication Data

US 2011/0177441 A1 Jul. 21, 2011

(51) Int. Cl.
*G03G 9/09* (2006.01)

(52) U.S. Cl. ..... 430/108.1; 430/104

(58) Field of Classification Search ..... 430/108.1, 430/104

See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,295,990 | A | 10/1981 | Verbeek et al. |
| 4,394,430 | A | 7/1983 | Jadwin et al. |
| 4,560,635 | A | 12/1985 | Hoffend et al. |
| 4,563,408 | A | 1/1986 | Lin et al. |
| 4,584,253 | A | 4/1986 | Lin et al. |
| 4,858,884 | A | 8/1989 | Harwath |
| 4,935,326 | A | 6/1990 | Creatura et al. |
| 4,937,166 | A | 6/1990 | Creatura et al. |
| 5,346,797 | A | 9/1994 | Kmiecik-Lawrynowicz et al. |
| 5,364,729 | A | 11/1994 | Kmiecik-Lawrynowicz et al. |
| 5,403,693 | A | 4/1995 | Patel et al. |
| 5,418,108 | A | 5/1995 | Kmiecik-Lawrynowicz et al. |
| 5,527,658 | A | 6/1996 | Hopper et al. |
| 5,585,215 | A | 12/1996 | Ong et al. |
| 5,650,255 | A | 7/1997 | Ng et al. |

(Continued)

OTHER PUBLICATIONS

Search Report from Application No. GB 1100914.9 dated Feb. 24, 2011.

*Primary Examiner* — Hoa V Le
(74) *Attorney, Agent, or Firm* — MDIP LLC

(57) ABSTRACT

The present disclosure provides processes for producing images of excellent color fidelity when incorporating a cyan toner with a lower colorant loading in addition to a first cyan toner. In embodiments, the cyan pigmented particles may be cyan emulsion aggregation toners. In accordance with the present disclosure, a pair of cyan toners are matched in color, wherein the color of a first cyan toner printed at a predetermined halftone area coverage on a substrate substantially matches the color of the solid (100%) printed patch of the second cyan toner, which is lighter than the first cyan toner, thus avoiding a visible hue shift on the print that would otherwise be objectionable. In embodiments, the light cyan toner is color matched by adding a hue-adjusting colorant or combination of colorants which absorb wavelengths of light between 500 and 600 nanometers, and optionally adding a shade-adjusting colorant or combination of colorants which absorb wavelengths of light between 400 and 500 nanometers.

20 Claims, 4 Drawing Sheets

U.S. PATENT DOCUMENTS

| | | | |
|---|---|---|---|
| 5,650,256 | A | 7/1997 | Veregin et al. |
| 5,853,943 | A | 12/1998 | Cheng et al. |
| 6,004,714 | A | 12/1999 | Ciccarelli et al. |
| 6,063,827 | A | 5/2000 | Sacripante et al. |
| 6,190,815 | B1 | 2/2001 | Ciccarelli et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,321,741 | B2 | 1/2008 | Sakamaki et al. |
| 7,355,750 | B2 | 4/2008 | Saito et al. |
| 7,386,261 | B2 | 6/2008 | Noguchi et al. |
| 7,426,294 | B2 | 9/2008 | Oki |
| 7,450,866 | B2 | 11/2008 | Sato |
| 7,463,837 | B2 | 12/2008 | Yasutomi |
| 2004/0013958 | A1 | 1/2004 | Ayaki et al. |
| 2004/0085556 | A1 | 5/2004 | Shibahara et al. |
| 2004/0135859 | A1 | 7/2004 | German et al. |
| 2005/0106481 | A1 | 5/2005 | Ayaki et al. |
| 2006/0222991 | A1 | 10/2006 | Sacripante et al. |
| 2008/0130054 | A1 | 6/2008 | Wang et al. |
| 2008/0130056 | A1 | 6/2008 | Wang et al. |

TONER COMPOSITIONS

BACKGROUND

The present disclosure relates to processes useful in providing toners suitable for electrophotographic apparatuses, including xerographic apparatuses such as digital, image-on-image, and similar apparatuses.

Numerous processes are known for the preparation of toners, such as, for example, conventional processes wherein a resin is melt kneaded or extruded with a pigment, micronized and pulverized to provide toner particles. Toner can also be produced by emulsion aggregation methods. Methods of preparing an emulsion aggregation (EA) type toner are within the purview of those skilled in the art, and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Color toners are utilized in electrophotographic apparatuses. Such colors may include, for example, cyan, magenta, yellow, and black. However, to reproduce certain lighter colors, light toners, such as light cyan and light magenta, may be desirable.

Obtaining light colorant toners is not as trivial as simply preparing a reduced loading of the fully pigmented color toners. There is significant hue difference between a low pigmented cyan toner and the fully pigmented cyan toner. This may be caused, in part, by unwanted absorptions leading to color variation across the tone reproduction curve (TRC).

Improved methods for producing color toners, including lighter colors, remain desirable.

SUMMARY

The present disclosure provides processes for producing toners and toners produced thereby. In embodiments, a toner of the present disclosure may include a light cyan toner including at least one resin; an optional wax; and a colorant including at least one cyan colorant, in combination with at least one hue-adjusting colorant that absorbs wavelengths of light from about 500 and to about 600 nanometers.

In other embodiments, a toner of the present disclosure may include a light cyan toner including at least one resin; one or more cyan colorants such as Pigment Blue 15:3, Pigment Blue 16, Solvent Blue 35, Solvent Blue 38, Solvent Blue 48, Solvent Blue 70, Solvent Blue 101, and combinations thereof, in a total amount of from about 0.1 percent by weight to about 3 percent by weight of the toner; at least one hue-adjusting colorant which absorbs wavelengths of light from about 500 to about 600 nanometers such as Pigment Blue 61, Pigment Red 57:1, Pigment Red 81:2, Pigment Red 122, Pigment Red 185, Pigment Red 238, Pigment Red 269, Solvent Red 52, Solvent Red 151, Solvent Red 155, Solvent Red 172, Solvent Violet 13, Solvent Blue 97, Solvent Blue 102, Solvent Blue 104, Solvent Blue 128, and combinations thereof in a total amount of from about 0.001 percent by weight to about 1 percent by weight of the toner; and optionally one or more shade-adjusting colorants which absorb wavelengths of light from about 400 to about 500 nanometers such as Pigment Blue 15:3, Pigment Blue 16, Pigment Blue 27, Pigment Blue 61, Pigment Green 4, Pigment Green 7, carbon black, and combinations thereof, in a total amount of from about 0.001 percent by weight to about 0.6 percent by weight of the toner.

In other embodiments, a toner of the present disclosure may include a light cyan toner including at least one resin; and one or more cyan colorants such as Pigment Blue 15:3, Pigment Blue 16, Solvent Blue 35, Solvent Blue 38, Solvent Blue 48, Solvent Blue 70, Solvent Blue 101, and combinations thereof, in a total amount of from about 0.1 percent by weight to about 3 percent by weight of the toner; at least one hue-adjusting colorant which absorbs wavelengths of light from about 500 to about 600 nanometers including Pigment Blue 61 in an amount from about 0.04 percent by weight to about 0.2 percent by weight of the toner; and optionally a shade-adjusting colorant which absorbs wavelengths of light from about 400 to about 500 nanometers including carbon black in an amount from about 0.003 percent by weight to about 0.05 percent by weight of the toner.

BRIEF DESCRIPTION OF THE FIGURES

Various embodiments of the present disclosure will be described herein below with reference to the figures wherein.

DETAILED DESCRIPTION OF EMBODIMENTS

Figure 1A:
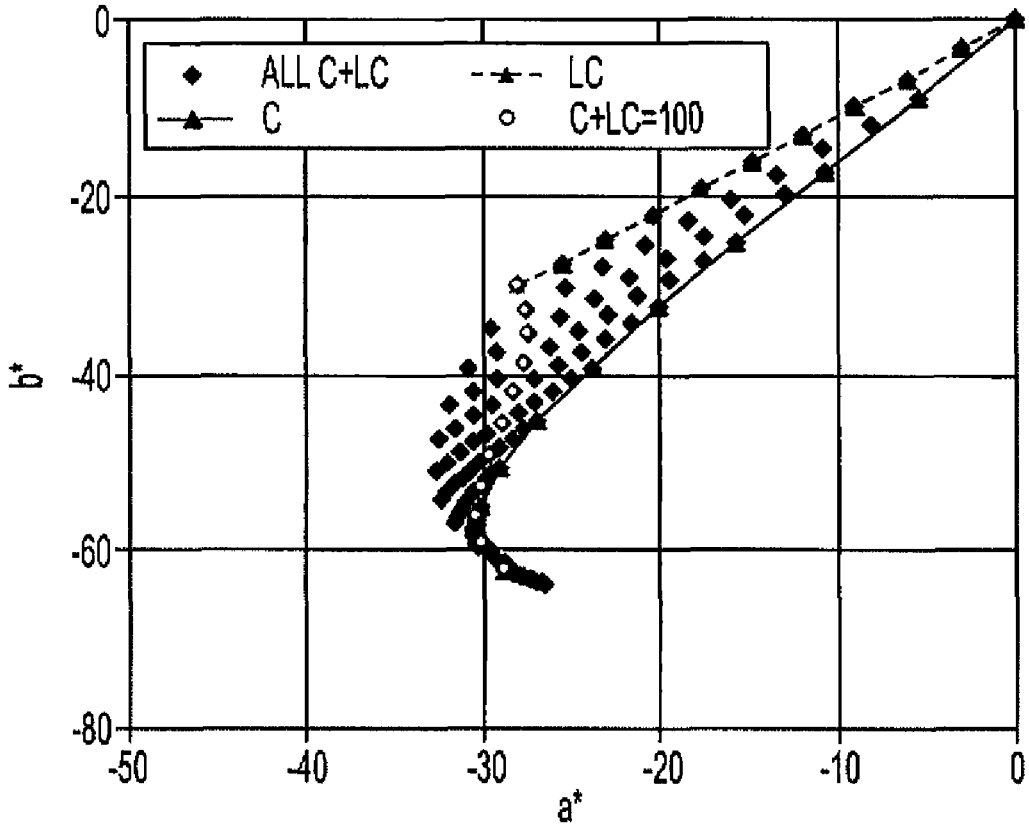
FIG. 1A is a graph of b* vs. a* depicting what typically happens when pigment loading is decreased to produce a light cyan toner.

The present disclosure provides processes for the preparation of toner particles which may avoid problems arising in the formation of lightly pigmented particles. In embodiments, the lightly pigmented particles may be light cyan emulsion aggregation (EA) toners suitable for use in custom color applications. In accordance with the present disclosure, a pigment system may be shaded with other colorants to smooth the toner reproduction curve (TRC) and correct for the hue shift otherwise observed between a fully pigmented toner and a low pigmented toner. The present disclosure provides for the development of a set of colorant mixtures for a light cyan toner given the hue and lightness desired. It should be understood that, unless otherwise stated, references to pigments are meant to include colorants (or combinations of colorants) in general, and without limitation.

Toners of the present disclosure may include a latex resin in combination with a pigment. While the latex resin may be prepared by any method within the purview of those skilled in the art, in embodiments the latex resin may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 micron to about 15 microns.

Resin

Any monomer suitable for preparing a latex for use in a toner may be utilized. Such latexes may be produced by conventional methods. As noted above, in embodiments the toner may be produced by emulsion aggregation. Suitable monomers useful in forming a latex emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the resin of the latex may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymer may be block, random, or alternating copolymers.

In embodiments, a poly(styrene-butyl acrylate) may be utilized as the latex. The glass transition temperature of this latex may be from about 35° C. to about 75° C., in embodiments from about 40° C. to about 70° C.

In other embodiments, the resin may be an amorphous resin, a crystalline resin, and/or a combination thereof. In further embodiments, the resin may be a polyester resin, including the resins described in U.S. Pat. Nos. 6,593,049 and 6,756,176, the disclosures of each of which are hereby incorporated by reference in their entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent (although amounts outside of these ranges can be used), and the alkali sulfo-aliphatic diol can be selected in an amount of from about 0 to about 10 mole percent, in embodiments from about 1 to about 4 mole percent of the resin (although amounts outside of these ranges can be used).

As the acid-derived component selected for the preparation of the crystalline resin, an aliphatic dicarboxylic acid may be utilized, in embodiments a straight chain carboxylic acid. Examples of straight chain carboxylic acids include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,1-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters and acid anhydrides thereof. Among these, ones having 6 to 10 carbon atoms may be suitable from the viewpoints of the crystal melting point and the charging properties. The organic diacid may be selected in an amount of, for example, in embodiments from about 40 to about 60 mole percent, in embodiments from about 42 to about 52 mole percent, in embodiments from about 45 to about 50 mole percent (although amounts outside of these ranges can be used), and the alkali sulfo-aliphatic diacid can be selected in an amount of from about 1 to about 10 mole percent of the resin (although amounts outside of these ranges can be used).

Such other monomers are not particularly restricted, and examples thereof include conventionally known divalent carboxylic acids and dihydric alcohols, for example those described in "Polymer Data Handbook: Basic Edition" (Soc. Polymer Science, Japan Ed.: Baihukan). Specific examples of the monomer components include, as divalent carboxylic acids, dibasic acids such as phthalic acid, isophthalic acid, terephthalic acid, naphthalene-2,6-dicarboxylic acid, naphthalene-2,7-dicarboxylic acid, and cyclohexanedicarboxylic acid, and anhydrides and lower alkyl esters thereof. Only one of these acids may be used, or alternatively, two or more of these acids may be used in combination.

As the acid-derived components, other than the aliphatic dicarboxylic acid-derived components, a component such as a dicarboxylic acid-derived component having a sulfonic acid group may be used.

The dicarboxylic acid having a sulfonic acid group is effective from the viewpoint of achieving excellent dispersion of a coloring agent such as a pigment. Furthermore, when a whole resin is emulsified or suspended in water to prepare a toner mother particle, a sulfonic acid group, as will be described below, enables the resin to be emulsified or suspended without a surfactant. Examples of such dicarboxylic acids having a sulfonic group include, but are not limited to, sodium 2-sulfoterephthalate, sodium 5-sulfoisophthalate and sodium sulfosuccinate. Furthermore, lower alkyl esters and acid anhydrides of such dicarboxylic acids having a sulfonic group, for example, are also usable. Among these, sodium 5-sulfoisophthalate and the like may be desirable in view of the cost. The content of the dicarboxylic acid having a sulfonic acid group may be from about 0.1% by mole to about 2.0% by mole, in embodiments from about 0.2% by mole to about 1.0% by mole. When the content is more than 2% by mole, the charging properties may be deteriorated. Here, "component mol %" indicates the percentage when the total amount of each of the components (acid-derived component and alcohol-derived component) in the polyester resin is assumed to be 1 unit (mole).

Furthermore, as needs arise, for the purpose of adjusting the acid number and hydroxyl number, the following may be used: monovalent acids such as acetic acid and benzoic acid; monohydric alcohols such as cyclohexanol and benzyl alcohol; benzenetricarboxylic acid, naphthalenetricarboxylic acid, and anhydrides and lower alkylesters thereof; trivalent alcohols such as glycerin, trimethylolethane, trimethylolpropane and pentaerythritol, as well as combinations of any of the foregoing.

The crystalline polyester resins may be synthesized from an arbitrary combination of components selected from the above-mentioned monomer components, by using a conventional known method described in, for example, Polycondensation (the Kagakudoj in), Polymer Experimental Study (polycondensation and polyaddition: KYORITSU SHUPPAN CO., LTD) and Polyester Resin Handbook (edited by Nikkan Kogyo Shimbun, Ltd.). The ester exchange method and the direct polycondensation method may be used singularly or in a combination thereof. The molar ratio (acid component/alcohol component) when the acid component and alcohol component are reacted varies depending on the reaction conditions. The molar ratio is usually about 1/1 in direct polycondensation. In the ester exchange method, a monomer such as ethylene glycol, neopentyl glycol or cyclohexanedimethanol, which may be distilled away under vacuum, is often used in excess.

The crystalline resin may be present, for example, in an amount of from about 5 to about 50 percent by weight of the toner components, in embodiments from about 10 to about 35 percent by weight of the toner components (although amounts outside of these ranges can be used). The crystalline resin can possess various melting points of, for example, from about 30° C. to about 120° C., in embodiments from about 50° C. to about 90° C. (although melting points outside of these ranges can be obtained). The crystalline resin may have a number average molecular weight ($M_n$), as measured by gel permeation chromatography (GPC) of, for example, from about 1,000 to about 50,000, in embodiments from about 2,000 to about 25,000 (although number average molecular weights outside of these ranges can be obtained), and a weight average molecular weight ($M_w$) of, for example, from about 2,000 to about 100,000, in embodiments from about 3,000 to about 80,000 (although weight average molecular weights outside of these ranges can be obtained), as determined by Gel Permeation Chromatography using polystyrene standards. The molecular weight distribution ($M_w/M_n$) of the crystalline resin may be, for example, from about 2 to about 6, in embodiments from about 3 to about 4 (although molecular weight distributions outside of these ranges can be obtained).

Examples of diacids or diesters including vinyl diacids or vinyl diesters utilized for the preparation of amorphous polyesters include dicarboxylic acids or diesters such as terephthalic acid, isophthalic acid, orthophthalic acid, and anhydrides thereof; in embodiments, terephthalic acid and/or isophthalic acid may be used. These acid components may be used singly or in a mixture of two or more thereof. Other acid components may be additionally used in combination with the acid components as long as any smell generated therefrom by flash fixing is not problematic. Examples of the additional acid components include maleic acid, fumaric acid, citraconic acid, itaconic acid, glutaconic acid, cyclohexanedicarboxylic acid, succinic acid, adipic acid, sebacic acid, azelaic acid and malonic acid, and also include alkyl- or alkenylsuccinic acids such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid or isododecenylsuccinic acid, and acid anhydrides and lower alkyl esters thereof as well as other divalent carboxylic acids. For crosslinking the polyester resin, carboxylic acid components of trivalent or more-valency may also be used as the additional acid components in a mixing manner. Examples of the trivalent or more carboxylic acid components can include 1,2,4-benzenetricarboxylic acid, 1,3,5-benzenetricarboxylic acid, other polycarboxylic acids, and anhydrides thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin (although amounts outside of these ranges can be used).

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin (although amounts outside of these ranges can be used).

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin (although amounts outside of this range can be used).

In embodiments, suitable resins may include a mixture of an amorphous polyester resin and a crystalline polyester resin as described in U.S. Pat. No. 6,830,860, the disclosure of which is hereby incorporated by reference in its entirety.

Surfactants

In embodiments, the latex may be prepared in an aqueous phase containing a surfactant or co-surfactant. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quatemized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl)propane]dihydrochloride, 2,2'-azobis{2-[1-(2-hydroxyethyl)-2-imidazolin-2-yl]propane}dihydrochloride, combinations thereof, and the like.

Initiators can be added in suitable amounts, such as from about 0.1 to about 8 weight percent, and in embodiments of from about 0.2 to about 5 weight percent of the monomers.

Chain Transfer Agents

In embodiments, chain transfer agents may also be utilized in forming the latex. Suitable chain transfer agents include dodecane thiol, octane thiol, carbon tetrabromide, combinations thereof, and the like. Where utilized, chain transfer agents may be present in amounts from about 0.1 to about 10 percent and, in embodiments, from about 0.2 to about 5 percent by weight of monomers, to control the molecular weight properties of the polymer when emulsion polymerization is conducted in accordance with the present disclosure.

Stabilizers

In embodiments, it may be advantageous to include a stabilizer when forming the latex particles. Suitable stabilizers include monomers having carboxylic acid functionality. Such stabilizers may be of the following formula (III):

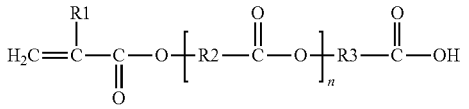

(III)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly(2-carboxyethyl)acrylate, 2-carboxyethyl methacrylate, combinations thereof, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

Where present, the stabilizer may be added in amounts from about 0.01 to about 5 percent by weight of the toner, in embodiments from about 0.05 to about 2 percent by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer is sodium carbonate, sodium bicarbonate, calcium carbonate, potassium carbonate, ammonium carbonate, combinations thereof, and the like. In embodiments a stabilizer may include a composition containing sodium silicate dissolved in sodium hydroxide.

pH adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Reaction Conditions

In the emulsion aggregation process, the reactants may be added to a suitable reactor, such as a mixing vessel. The appropriate amount of at least two monomers, in embodiments from about two to about ten monomers, stabilizer, surfactant(s), initiator, if any, chain transfer agent, if any, and wax, if any, and the like may be combined in the reactor and the emulsion aggregation process may be allowed to begin. Suitable waxes are described in greater detail below as a component to be added in the formation of a toner particle; such waxes may also be useful, in embodiments, in forming a latex. Reaction conditions selected for effecting the emulsion polymerization include temperatures of, for example, from about 45° C. to about 120° C., in embodiments from about 60° C. to about 90° C. In embodiments the polymerization may occur at elevated temperatures within about 10 percent of the melting point of any wax present, for example from about 60° C. to about 85° C., in embodiments from about 65° C. to about 80° C., to permit the wax to soften thereby promoting dispersion and incorporation into the emulsion.

Nanometer size particles may be formed, from about 50 nm to about 800 nm in volume average diameter, in embodiments from about 100 nm to about 400 nm in volume average diameter, as determined, for example, by a Brookhaven nanosize particle analyzer.

After formation of the latex particles, the latex particles may be utilized to form a toner. In embodiments, the toners may be an emulsion aggregation type toner that are prepared by the aggregation and fusion of the latex particles of the present disclosure with a colorant, and one or more additives such as surfactants, coagulants, waxes, surface additives, and optionally combinations thereof.

Colorants

The latex particles produced as described above may be added to a colorant to produce a toner. In embodiments the colorant may be in a dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. Suitable surfactants include any of those surfactants described above. In embodiments, the surfactant may be ionic and may be present in a dispersion in an amount from about 0.1 to about 25 percent by weight of the colorant, and in embodiments from about 1 to about 15 percent by weight of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants, and the like.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™H; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 4™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido)phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight of the toner, in embodiments, from about 5 to about 18 weight percent of the toner.

In embodiments, colorant examples include Pigment Blue 15:3 having a Color Index Constitution Number of 74160, Pigment Blue 61, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant.

The vast majority of digital imaging is carried out by halftoning of some type. While the halftone dots themselves are typically small enough that they are not visible, the texture produced by these dots is visible, and may be unacceptable for certain high quality applications, such as printing high quality photographs. In addition to objectionable halftone texture, even small levels of nonuniformity can lead to objectionable visible noise, such as graininess, mottle, etc. The objectionable visible texture and noise can be significantly reduced by the use of light toners.

In embodiments, toners of the present disclosure may be produced which are lighter (i.e., they have a higher lightness or CIE L* value) than a conventional color toner and may be referred to, in embodiments, as a "light cyan" a "light magenta", etc. If the light toners are made simply by reducing the colorant concentration below that used in the corresponding conventional toners, in general the color of the light toner is significantly shifted relative to that of the conventional toner when halftoned to the same lightness. This can lead to objectionable color discontinuities when transitioning from the light toner to the conventional toner. In embodiments, by proper selection of combinations of colorants utilized in the formulation of these light toners, it is possible to compensate for the above mentioned undesirable color shift, such that the transition from the light toner to the conventional toner occurs smoothly and is not objectionable.

Measurement of the color can, for example, be characterized by CIE (Commission International de I'Eclairage) specifications, commonly referred to as CIELAB, where L*, a* and b* are the modified opponent color coordinates, which form a 3 dimensional space, with L* characterizing the lightness of a color, a* approximately characterizing the redness, and b* approximately characterizing the yellowness of a color. The pigment concentration should be chosen so that lightness (L*) corresponds with the desired toner mass on the substrate. All of these parameters may be measured with any industry standard spectrophotometer including those obtained, for example, from X-Rite Corporation.

In embodiments, a light cyan toner of the present disclosure may possess an L* value of from about 10 to about 45 units above that of the conventional cyan toner used in the printing system, in embodiments from about 20 to about 35 units above that of the conventional cyan toner, when both toners are printed at 100% area coverage. Thus, a light cyan may include, for example, toners having a lighter color compared to the conventional cyan color, which, in embodiments, may have a lightness from about 120% to about 200% that of the conventional cyan toner, in other embodiments from about 140% to about 170% that of the conventional cyan toner.

In other embodiments, the present disclosure may include a pair of matched cyan toners, including the light cyan toner of the present disclosure together with a second conventional cyan toner, wherein the color of the second cyan toner printed at a predetermined halftone area coverage on a substrate substantially matches the color of the solid (100%) printed patch of the light cyan toner of the present disclosure.

As stated earlier, it is not sufficient to simply achieve these L* values, but to match the color of a particular halftoned tint of the conventional cyan toner. In embodiments, the color of the light cyan toner may match the color of a halftone of the conventional cyan toner between about 10% and about 70% area coverage, in other embodiments, between about 30% and about 50% area coverage.

In embodiments, a light cyan of the present disclosure may be produced by combining a cyan colorant such as Pigment Blue 15:3, Pigment Blue 16, Solvent Blue 35, Solvent Blue 38, Solvent Blue 48, Solvent Blue 70, Solvent Blue 101, and combinations thereof, in an amount of from about 0.1 percent by weight to about 3 percent by weight of the toner, in embodiments from about 0.4 percent by weight to about 1.5 percent by weight of the toner, with a hue-adjusting colorant in an amount of from about 0.001 percent by weight to about 1 percent by weight of the toner, in embodiments from about 0.04 percent by weight to about 0.2 percent by weight of the toner, and optionally a shade-adjusting colorant in an amount from about 0.001 percent by weight to about 0.6 percent by weight of the toner, in embodiments from about 0.003 percent by weight to about 0.05 percent by weight of the toner. The cyan colorant may be a colorant or combination of colorants which absorb wavelengths of light from about 600 to about 700 nm. A hue-adjusting colorant for a light cyan toner is a colorant or combination of colorants which absorb wavelengths of light from about 500 to about 600 nanometers, and includes, for example, blue, magenta and red colorants such as Pigment Blue 61, Pigment Red 57:1, Pigment Red 81:2, Pigment Red 122, Pigment Red 185, Pigment Red 238, Pigment Red 269, Solvent Red 52, Solvent Red 151, Solvent Red 155, Solvent Red 172, Solvent Violet 13, Solvent Blue 97, Solvent Blue 102, Solvent Blue 104, Solvent Blue 128, and combinations thereof. A shade-adjusting colorant for a light cyan toner is a colorant or combination of colorants which absorb wavelengths of light from about 400 to about 500 nanometers, and includes, for example, yellow, orange, red and black colorants such as Pigment Yellow 12, Pigment Yellow 17, Pigment Yellow 74, Pigment Yellow 83, Pigment Yellow 97, Pigment Yellow 180, Pigment Orange 2, Pigment Orange 5, Pigment Orange 38, Pigment Orange 64, Pigment Red 4, Pigment Red 38, Pigment Red 66, Pigment Red 119, Pigment Red 178, Carbon Black, Solvent Yellow 16, Solvent Yellow 93, Solvent Yellow 104, Solvent Yellow 163, Solvent Yellow 141, Solvent Red 111, Solvent Black 7, and combinations thereof.

The resulting latex, optionally in a dispersion, and colorant dispersion may be stirred and heated to a temperature of from about 35° C. to about 70° C., in embodiments of from about 40° C. to about 65° C., resulting in toner aggregates of from about 2 microns to about 10 microns in volume average diameter, and in embodiments of from about 5 microns to about 8 microns in volume average diameter.

Coagulants

In embodiments, a coagulant may be added during or prior to aggregating the latex and the aqueous colorant dispersion. The coagulant may be added over a period of time from about 1 minute to about 60 minutes, in embodiments from about 1.25 minutes to about 20 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, and in embodiments from about 0.1 to about 3 percent by weight of the toner.

Aggregating Agents

Any aggregating agent capable of causing complexation might be used in forming toners of the present disclosure. Both alkaline earth metal or transition metal salts can be utilized as aggregating agents. In embodiments, alkaline earth salts can be selected to aggregate latex resin colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

Wax

Wax dispersions may also be added during formation of a latex or toner in an emulsion aggregation synthesis. Suitable waxes include, for example, submicron wax particles in the size of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasel K.K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may be present in an amount of from about 0.1 to about 30 percent by weight of the toner, and in embodiments from about 2 to about 20 percent by weight of the toner.

pH Adjustment Agent

In some embodiments a pH adjustment agent may be added to the latex, colorant, and optional additives, to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

For example, once the desired final size of the toner particles is achieved, the pH of the mixture may be adjusted with a base to a value of from about 3.5 to about 7, and in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The resultant blend of latex, optionally in a dispersion, stabilizer, optional wax, colorant dispersion, optional coagulant, and optional aggregating agent, may then be stirred and heated to a temperature below the Tg of the latex, in embodiments from about 30° C. to about 70° C., in embodiments of from about 40° C. to about 65° C., for a period of time of from about 0.2 hours to about 6 hours, in embodiments from about 0.3 hours to about 5 hours, to form aggregated particles.

In embodiments, an optional shell may then be formed on the aggregated particles. Any latex described above to form the latex may be utilized to form the shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

Where used, the shell latex may be applied by any method within the purview of those skilled in the art, including dipping, spraying, and the like. In embodiments, a shell may be applied by adding additional latex to the aggregated particles and allowing this additional latex to aggregate on the surface of the particles, thereby forming a shell thereover. Any resin within the purview of those skilled in the art, including those resins described above, may be utilized as a shell latex. The shell latex may be applied until the desired final size of the toner particles is achieved, in embodiments from about 2 microns to about 10 microns, in other embodiments from about 4 microns to about 8 microns.

Coalescence

The mixture of latex, colorant, optional wax, and any additives, is subsequently coalesced. Coalescing may include stirring and heating at a temperature of from about 80° C. to about 99° C., for a period of from about 0.5 to about 12 hours, and in embodiments from about 1 to about 6 hours. Coalescing may be accelerated by additional stirring.

Subsequent Treatments

In embodiments, after coalescence, the pH of the mixture may then be lowered to from about 3.5 to about 6 and, in embodiments, to from about 3.7 to about 5.5 with, for example, an acid, to further coalesce the toner aggregates. Suitable acids include, for example, nitric acid, sulfuric acid, hydrochloric acid, citric acid and/or acetic acid. The amount of acid added may be from about 0.1 to about 30 percent by weight of the mixture, and in embodiments from about 1 to about 20 percent by weight of the mixture.

The mixture may be cooled, washed and dried. Cooling may be at a temperature of from about 20° C. to about 40° C., in embodiments from about 22° C. to about 30° C., over a period of time of from about 1 hour to about 8 hours, in embodiments from about 1.5 hours to about 5 hours.

In embodiments, optional cooling a coalesced toner slurry may include quenching by adding a cooling media such as, for example, ice, dry ice and the like, to effect rapid cooling to a temperature of from about 20° C. to about 40° C., in embodiments of from about 22° C. to about 30° C. Quenching may be feasible by the use of jacketed reactor cooling.

The toner slurry may then be washed. The washing may be carried out at a pH of from about 7 to about 12, in embodiments at a pH of from about 9 to about 11. The washing may be at a temperature of from about 30° C. to about 70° C., in embodiments from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

The toner of the present disclosure may possess particles having a size of from about 3.5 to about 10 microns, in embodiments from about 4.5 to about 8.5 microns. As noted above, the resulting toner particles may have a circularity greater than about 0.95, in embodiments from about 0.95 to about 0.998, in embodiments of from about 0.955 to about 0.97. When the spherical toner particles have a circularity in this range, the spherical toner particles remaining on the surface of the image holding member pass between the contacting portions of the imaging holding member and the contact charger, the amount of deformed toner is small, and therefore generation of toner filming can be prevented so that a stable image quality without defects can be obtained over a long period.

Additives

The toner may also include charge additives in effective amounts of, for example, from about 0.1 to about 10 weight percent of the toner, in embodiments from about 0.5 to about 7 weight percent of the toner. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, combinations thereof, and the like.

Further optional additives include any additive to enhance the properties of toner compositions. Included are surface additives, color enhancers, and the like. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.1 to about 10 weight percent, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight, in embodiments from about 0.1 to about 2 percent by weight of the toner, which additives can be added during the aggregation or blended into the formed toner product.

Uses

Toner in accordance with the present disclosure can be used in a variety of imaging devices including printers, copy machines, and the like. The toners generated in accordance with the present disclosure are excellent for imaging processes, especially xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

The imaging process includes the generation of an image in an electronic printing apparatus and thereafter developing the image with a toner composition of the present disclosure. The formation and development of images on the surface of photoconductive materials by electrostatic means is within the purview of those skilled in the art. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat. Nos. 4,937,166 and 4,935,326, the disclosures of each of which are hereby incorporated by reference in their entirety. The toner-to-carrier mass ratio of such developers may be from about 2 to about 20 percent, and in embodiments from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidene fluoride, mixtures of resins not in close proximity in the triboelectric series such as polyvinylidene fluoride and acrylics, thermosetting resins such as acrylics, mixtures thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may also be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,858,884, 4,584,253 and 4,563,408, the disclosures of each of which are hereby incorporated by reference in their entirety. The imaging process includes the generation of an image in an electronic printing magnetic image character recognition apparatus and thereafter developing the image with a toner composition of the present disclosure. The formation and development of images on the surface of photoconductive materials by electrostatic means is within the purview of those skilled in the art. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

In embodiments, for color printing, multiple colored toners may be utilized to form images. In embodiments, these toners may include pure primary colorants of cyan, magenta, yellow, and black. In other embodiments, additional colors may be utilized, including red, blue, and green, in addition to the primary colors of cyan, magenta, and yellow. Other designs may include colorants representing the light cyan described above, light magenta, light yellow, light black or grey, combinations thereof, and the like.

In some embodiments, an imaging system of the present disclosure may include five or more colors, with at least one of them being the light cyan described above. In some embodiments, the other colors may include cyan, magenta, yellow, and/or black.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Preparation of a latex resin with a low glass transition temperature (Tg). A latex emulsion (designated as resin A), including polymer particles generated from the emulsion polymerization of styrene, n-butyl acrylate and beta-carboxyethyl acrylate, was prepared as follows.

A surfactant solution including about 605 grams of DOWFAX™ 2A1, an alkyldiphenyloxide disulfonate from The Dow Chemical Company, and about 387 kilograms of de-ionized water was prepared by mixing for about 10 minutes in a stainless steel holding tank. The holding tank was then purged with nitrogen for about 5 minutes before transferring into a reactor. The reactor was continuously purged with nitrogen while being stirred at about 100 revolutions per minute (rpm). The reactor was then heated to about 80° C.

Separately, about 6.1 kilograms of ammonium persulfate initiator was dissolved in about 30.2 kilograms of de-ionized water to form an initiator solution.

A monomer emulsion was prepared in the following manner. About 311.4 kilograms of styrene, about 95.6 kilograms of butyl acrylate, about 12.21 kilograms of beta-carboxyethyl acrylate, about 2.88 kilograms of 1-dodecanethiol, about 1.42 kilograms of dodecanediol diacrylate (A-DOD), about 8.04 kilograms of DOWFAX™ 2A1, and about 193 kilograms of deionized water were mixed to form an emulsion.

About 1% of the above monomer emulsion was then slowly fed into the reactor containing the aqueous surfactant phase at about 80° C. to form "seeds" while being purged with nitrogen. The initiator solution was then slowly charged into the reactor and, after about 10 minutes, the rest of the emulsion was continuously fed into the reactor using a metering pump at a rate of about 0.5%/minute. Once all the monomer emulsion was charged into the main reactor, the temperature was held at about 80° C. for an additional 2 hours to complete the reaction.

The reactor was then cooled until the reactor temperature was reduced to about 35° C. The product was collected into a holding tank. After drying the latex, the molecular properties were: weight average molecular weight (Mw) was about 35,419; number average molecular weight (Mn) was about 11,354; and the onset glass transition temperature (Tg) was about 51° C.

Example 2

Preparation of a latex resin with a high glass transition temperature (Tg). A latex emulsion (designated as resin B)

including polymer particles generated from the emulsion polymerization of styrene, n-butyl acrylate and beta-carboxyethyl acrylate was prepared as follows.

A surfactant solution including about 605 grams DOWFAX™ 2A1, and about 387 kilograms de-ionized water was prepared by mixing for about 10 minutes in a stainless steel holding tank. The holding tank was then purged with nitrogen for about 5 minutes before transferring into a reactor. The reactor was continuously purged with nitrogen while being stirred at about 100 revolutions per minute (rpm). The reactor was then heated to about 80° C.

Separately, about 6.1 kilograms of ammonium persulfate initiator was dissolved in about 30.2 kilograms of de-ionized water to form an initiator solution.

A monomer emulsion was prepared in the following manner. About 332.5 kilograms of styrene, about 74.5 kilograms of butyl acrylate, about 12.21 kilograms of beta-carboxyethyl acrylate, about 2.88 kilograms of 1-dodecanethiol, about 1.42 kilograms of dodecanediol diacrylate (A-DOD), about 8.04 kilograms of DOWFAX™ 2A1, and about 193 kilograms of deionized water were mixed to form an emulsion.

About 1% of the above monomer emulsion was then slowly fed into the reactor containing the aqueous surfactant phase at about 80° C. to form "seeds" while being purged with nitrogen. The initiator solution was then slowly charged into the reactor and, after about 10 minutes, the rest of the emulsion was continuously fed into the reactor using a metering pump at a rate of about 0.5%/minute. Once all the monomer emulsion was charged into the main reactor, the temperature was held at about 80° C. for an additional 2 hours to complete the reaction.

The reactor was then cooled until the reactor temperature was reduced to about 35° C. The product was collected into a holding tank. After drying the latex, the molecular properties were: Mw was about 33,700; Mn was about 10,900; and the onset Tg was about 58.6° C.

Example 3

Preparation of a toner. About 286.9 grams of resin A from Example 1, having a solids loading of about 41.4 percent by weight, and about 60.49 grams of a wax emulsion including a purified paraffin wax containing about 42 carbon atoms and having a solids loading of about 30.5% by weight, were added to about 613.5 grams of deionized water in a vessel and stirred using an IKA Ultra Turrax T50 homogenizer operating at about 4,000 rpm. Thereafter, a pigment mixture as shown in Table 1 below was added to the reactor, with three toners prepared with the two different pigment mixtures and PB 15:3 by itself as a control. After addition of the pigment, about 36 grams of a flocculent mixture containing about 3.6 grams polyaluminum chloride and about 32.4 grams of an about 0.02 molar nitric acid solution was added dropwise. As the flocculent mixture was added drop-wise, the homogenizer speed was increased to about 5,200 rpm and homogenized for an additional 5 minutes.

Thereafter, the mixture was heated at a rate of about 1° C. per minute to a temperature of about 51° C. and held there for a period of from about 1.5 hours to about 2 hours resulting in a volume average particle diameter of about 5 microns as measured with a Coulter Counter. During the heating, the stirrer was run at about 250 rpm; about 10 minutes after the set temperature of about 49° C. was reached, the stirrer speed was reduced to about 220 rpm.

About 134.6 grams of latex resin B from Example 2, having a solids loading of about 41.6 percent by weight, was then added to the reactor mixture and allowed to aggregate for an additional period of about 30 minutes at about 51° C. resulting in a volume average particle diameter of about 5.7 microns.

The pH of the reactor mixture was adjusted to a pH of about 4 with a 1 M sodium hydroxide solution followed by the addition of about 4.82 grams of VERSENE 100 (ethylenediamine tetraacetate (EDTA) from Dow Chemical) chelating agent. The resulting pH was about 6.5. The pH was then decreased to about 5.6 using about 0.02 M $HNO_3$.

Thereafter, the reactor mixture was heated at about 1° C. per minute to reach a temperature of about 95° C. Following this, the reaction mixture was gently stirred at about 95° C. for about 3 hours to enable the particles to coalesce and spherodize.

After about 1 hour of coalescence, the pH of the contents of the reactor was adjusted to about 7, and the reactor mixture was gently stirred for the remaining 2 hours. The reactor heater was then turned off and the reactor mixture was allowed to cool to room temperature at a rate of about 1° C. per minute.

The resulting toner had a volume average particle diameter of about 5.7 microns and a GSD of about 1.19 as determined by a Coulter size analyzer.

Toner patches were prepared using a wet deposition method followed by envelope fusing using a GBC3500 Laminator from GBC. As noted above, an unshaded toner, i.e., one produced without a light cyan pigment mixture, was utilized as a control.

As mentioned earlier, in order to avoid objectionable color discontinuities in a printed image, it may be necessary to achieve a smooth transition between colors produced by the light cyan toner and colors produced by the nominal cyan toner. The uncorrected light cyan toner fails to meet this requirement, since its halftone trajectory is significantly different from the target halftone trajectory of the nominal cyan toner. This difference in color is caused by a change in hue angle upon decreasing the pigment loading, resulting in a $\Delta E$ color difference from the target curve of 11.3, for a developed toner mass per unit area (TMA) of 0.45 mg/cm$^2$. This is a significant difference since the human eye can detect color differences as small as $\Delta E$ close to 1 under some conditions.

Figure 1B:
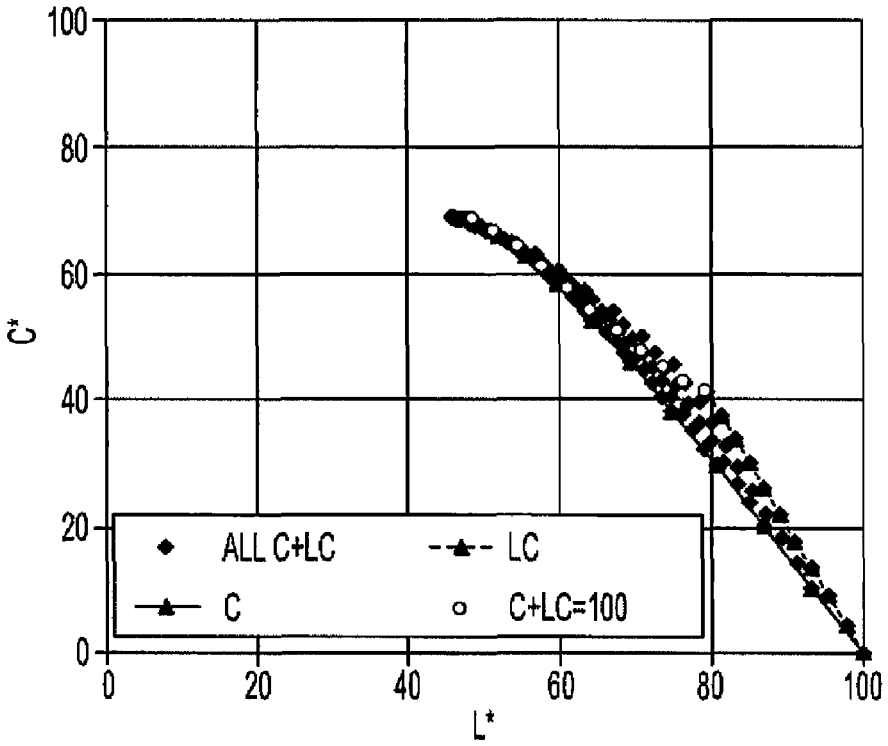
FIG. 1B is a graph of chroma vs. lightness depicting what typically happens when pigment loading is decreased to produce a light cyan toner.

This color difference between the halftone trajectories of the cyan and uncorrected light cyan toners occurs in all three dimensions (L*, a* and b*), but for ease of representation it is shown as two separate two-dimensional views in FIG. 1A and FIG. 1B. FIG. 1A is a plot of b* vs. a* and clearly shows the discrepancy in hue between the two trajectories. In particular, the trajectory of the combination of cyan and uncorrected light cyan toners, after the uncorrected light cyan toner has reached 100%, is convoluted. FIG. 1B is a plot of chroma C* vs. lightness L*, showing that at any given chroma, the uncorrected light cyan toner is also lighter than the nominal cyan toner.

Using the Kubelka-Munk color model for solids and the YNN color model for halftones, pigment formulations were provided to correct for this significantly large hue shift. Two different pigment formulation options were provided, one shaded with a blue pigment (PB61) and the other with a mixture of two magenta pigments (PR122 and PR269). As noted above, two light cyan toners were prepared utilizing these two different pigment formulations, as set forth in Table 1. After these toner particles were prepared, wet deposition samples were produced at the target TMA of 0.45 mg/cm$^2$ and the color properties were measured as shown in Table 1.

TABLE 1

Light Cyan Toner examples with relative colorimetry Lab values, and prediction error to the target in deltaE$_{2000}$

| Toner ID | L | a | b | CIE dE | dE 2000 | Pigment Type | Pigment Loading (wt. %) |
|---|---|---|---|---|---|---|---|
| Unshaded | 79.2 | −30.9 | −31.2 | 11.3 | 6.3 | PB 15:3 | 0.68 |
| Light Cyan 1 | 71.3 | −20.2 | −32.8 | 2.9 | 2.1 | PB 15:3/PB 61/R 330 | 0.504/0.12/0.0261 |
| Light Cyan 2 | 71.4 | −20.3 | −33.9 | 3.4 | 2.0 | PB 15:3/PR 122/PR 269/R 330 | 0.6915/0.065/0.065/0.0104 |

PB 15:3 = Pigment Blue 15:3
PB 61 = Pigment Blue 61
R 330 = Regal 330 Carbon Black
PR 122 = Pigment Red 122
PR 269 = Pigment Red 269

Table 1 above shows the pigment concentrations for the hue corrected light cyan toners. Also, the color analysis is displayed showing the close match (low color error dE) between the experimental toners and the light cyan target. The target color was defined as the 40% area coverage point on the halftone trajectory of the nominal cyan toner, which in this case was the color [L=73.9, a=−21.6, b=−34.7].

Figure 2A:
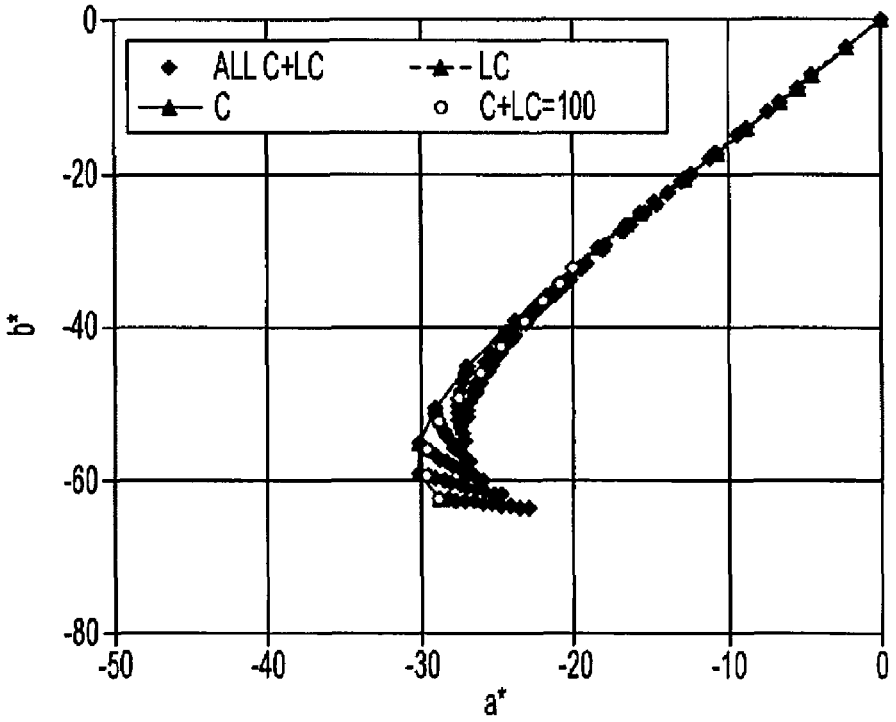
FIG. 2A is a graph of b* vs a* depicting the halftone trajectory of a light cyan toner of the present disclosure.
Figure 2B:
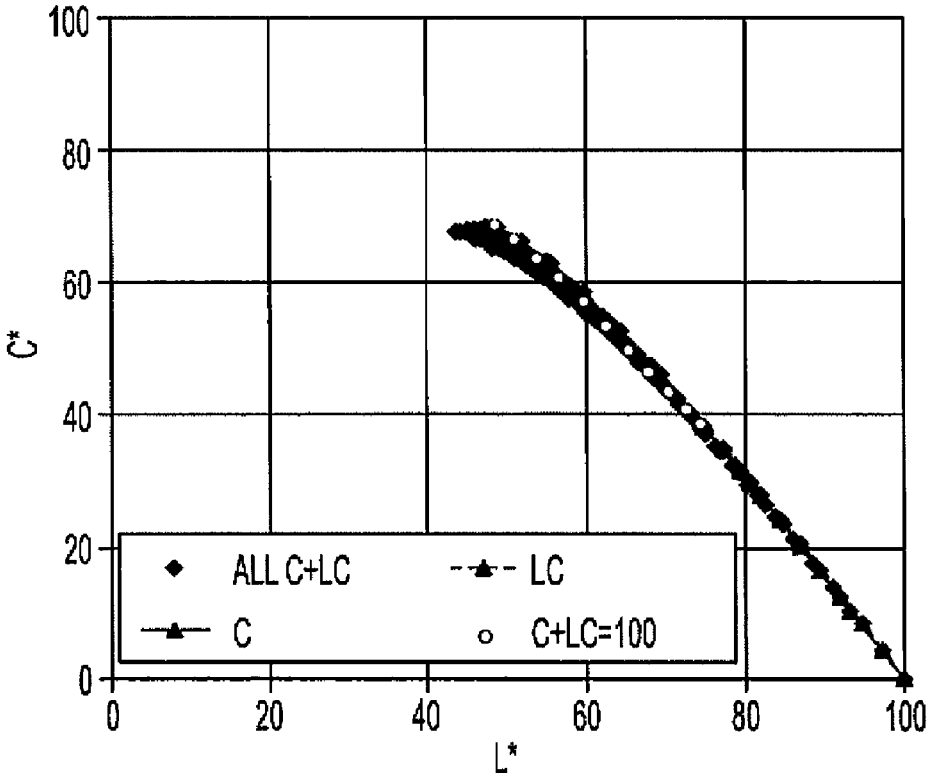
FIG. 2B is a graph of chroma vs. lightness depicting the halftone trajectory of a light cyan toner of the present disclosure.

FIG. 2 depicts color results for the corrected light cyan toner #1, in a manner exactly analogous to FIG. 1. As can be seen in FIG. 2A, there is virtually no discrepancy in hue between the trajectories of the cyan and corrected light cyan toners. In particular, the trajectory of the combination of cyan and corrected light cyan toners, after the uncorrected light cyan toner has reached 100%, is smooth and continuous. FIG. 2B is a plot of chroma C* vs. lightness L*, showing that at any given chroma, the corrected cyan toner accurately matches the lightness and chroma of the halftoned nominal cyan toner.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A light cyan toner comprising:
at least one resin;
an optional wax; and
a colorant comprising at least one cyan colorant, in combination with at least one hue-adjusting colorant that absorbs wavelengths of light from about 500 and to about 600 nanometers.

2. A light cyan toner according to claim 1, further optionally comprising a shade-adjusting colorant or combination of colorants which absorb wavelengths of light from about 400 and to about 500 nanometers.

3. A light cyan toner according to claim 1, wherein the cyan colorant is selected from the group consisting of Pigment Blue 15:3, Pigment Blue 16, Solvent Blue 35, Solvent Blue 38, Solvent Blue 48, Solvent Blue 70, Solvent Blue 101, and combinations thereof, in a total amount of from about 0.1 percent by weight to about 3 percent by weight of the toner, and wherein the cyan colorant absorbs wavelengths of light from about 600 to about 700 nm.

4. A light cyan toner according to claim 1, wherein the hue-adjusting colorant is selected from the group consisting of Pigment Blue 61, Pigment Red 57:1, Pigment Red 81:2, Pigment Red 122, Pigment Red 185, Pigment Red 238, Pigment Red 269, Solvent Red 52, Solvent Red 151, Solvent Red 155, Solvent Red 172, Solvent Violet 13, Solvent Blue 97, Solvent Blue 102, Solvent Blue 104, Solvent Blue 128, and combinations thereof, in a total amount of from about 0.001 percent by weight to about 1 percent by weight of the toner.

5. A light cyan toner according to claim 2, wherein the shade-adjusting colorant is selected from the group consisting of Pigment Yellow 12, Pigment Yellow 17, Pigment Yellow 74, Pigment Yellow 83, Pigment Yellow 97, Pigment Yellow 180, Pigment Orange 2, Pigment Orange 5, Pigment Orange 38, Pigment Orange 64, Pigment Red 4, Pigment Red 38, Pigment Red 66, Pigment Red 119, Pigment Red 178, Carbon Black, Solvent Yellow 16, Solvent Yellow 93, Solvent Yellow 104, Solvent Yellow 163, Solvent Yellow 141, Solvent Red 111, Solvent Black 7, and combinations thereof, in a total amount of from about 0.001 percent by weight to about 0.6 percent by weight of the toner.

6. A toner according to claim 1, wherein the hue-adjusting colorant comprises Pigment Blue 61 in an amount from about 0.04 percent by weight to about 0.2 percent by weight of the toner.

7. A toner according to claim 2, wherein the shade-adjusting colorant comprises Carbon Black in an amount from about 0.003 percent by weight to about 0.05 percent by weight of the toner.

8. A toner according to claim 1, wherein the at least one resin is selected from the group consisting of styrenes, acrylates, methacrylates, butadienes, isoprenes, acrylic acids, methacrylic acids, acrylonitriles, and combinations thereof.

9. A toner according to claim 1, wherein the at least one resin comprises at least one amorphous polyester.

10. A toner according to claim 1, wherein the at least one resin comprises at least one crystalline polyester.

11. A toner according to claim 1, wherein the toner comprises an emulsion aggregation toner, and wherein the toner further comprising comprises a wax selected from the group consisting of carnauba wax, candelilla wax, Japan wax, bayberry wax, beeswax, punic wax, lanolin, lac wax, shellac wax, spermaceti wax, paraffin wax, microcrystalline wax, montan wax, ozokerite wax, ceresin wax, petrolatum wax, petroleum wax, Fischer-Tropsch wax, acrylate wax, fatty acid amide wax, silicone wax, polytetrafluoroethylene wax, polyethylene wax, polypropylene wax, and combinations thereof.

12. A pair of matched cyan toners, comprising the light cyan toner of claim 1 together with a second cyan toner, wherein the color of the second cyan toner printed at a predetermined halftone area coverage on a substrate substantially matches the color of the solid (100%) printed patch of the light cyan toner of claim 1.

13. A pair of matched cyan toners according to claim 12, wherein the predetermined halftone area coverage of the second cyan toner, at which the two cyan toners match, lies in the range from about 10% to about 70% area coverage.

14. A pair of cyan toners according to claim 12, wherein the light cyan toner possesses a lightness L* value of from about 10 to about 45 units above that of the second cyan toner, when both toners are printed at 100% area coverage.

15. A light cyan toner comprising:

at least one resin;

one or more cyan colorants selected from the group consisting of Pigment Blue 15:3, Pigment Blue 16, Solvent Blue 35, Solvent Blue 38, Solvent Blue 48, Solvent Blue 70, Solvent Blue 101, and combinations thereof, in a total amount of from about 0.1 percent by weight to about 3 percent by weight of the toner;

at least one hue-adjusting colorant which absorbs wavelengths of light from about 500 to about 600 nanometers selected from the group consisting of Pigment Blue 61, Pigment Red 57:1, Pigment Red 81:2, Pigment Red 122, Pigment Red 185, Pigment Red 238, Pigment Red 269, Solvent Red 52, Solvent Red 151, Solvent Red 155, Solvent Red 172, Solvent Violet 13, Solvent Blue 97, Solvent Blue 102, Solvent Blue 104, Solvent Blue 128, and combinations thereof in a total amount of from about 0.001 percent by weight to about 1 percent by weight of the toner; and optionally one or more shade-adjusting colorants which absorb wavelengths of light from about 400 to about 500 nanometers selected from the group consisting of Pigment Blue 15:3, Pigment Blue 16, Pigment Blue 27, Pigment Blue 61, Pigment Green 4, Pigment Green 7, carbon black, and combinations thereof, in a total amount of from about 0.001 percent by weight to about 0.6 percent by weight of the toner.

16. A toner according to claim 15, wherein the at least one resin is selected from the group consisting of styrenes, acrylates, methacrylates, butadienes, isoprenes, acrylic acids, methacrylic acids, acrylonitriles, and combinations thereof.

17. A toner according to claim 15, wherein the at least one resin comprises at least one amorphous polyester.

18. A toner according to claim 15, wherein the at least one resin comprises at least one crystalline polyester.

19. A light cyan toner comprising:

at least one resin; and one or more cyan colorants selected from the group consisting of Pigment Blue 15:3, Pigment Blue 16, Solvent Blue 35, Solvent Blue 38, Solvent Blue 48, Solvent Blue 70, Solvent Blue 101, and combinations thereof, in a total amount of from about 0.1 percent by weight to about 3 percent by weight of the toner;

at least one hue-adjusting colorant which absorbs wavelengths of light from about 500 to about 600 nanometers comprising Pigment Blue 61 in an amount from about 0.04 percent by weight to about 0.2 percent by weight of the toner; and optionally a shade-adjusting colorant which absorbs wavelengths of light from about 400 to about 500 nanometers comprising carbon black in an amount from about 0.003 percent by weight to about 0.05 percent by weight of the toner.

20. A toner according to claim 19, wherein the at least one resin is selected from the group consisting of polyesters, styrenes, acrylates, methacrylates, butadienes, isoprenes, acrylic acids, methacrylic acids, acrylonitriles, and combinations thereof.

* * * * *